United States Patent [19]

Knapp et al.

[11] Patent Number: 4,877,482

[45] Date of Patent: Oct. 31, 1989

[54] NITRIDE REMOVAL METHOD

[75] Inventors: James H. Knapp, Gilbert; George F. Carney; Francis J. Carney, both of Tempe, all of Ariz.

[73] Assignee: Motorola Inc., Schaumburg, Ill.

[21] Appl. No.: 327,630

[22] Filed: Mar. 23, 1989

[51] Int. Cl.[4] ..... B44C 1/22; C03C 15/00; C03C 25/06

[52] U.S. Cl. ..... 156/643; 134/1; 134/26; 134/30; 156/646; 156/655; 204/192.35

[58] Field of Search ..... 156/643, 646, 653, 655, 156/656; 204/192.32, 192.35; 134/1, 26, 30

[56] References Cited

U.S. PATENT DOCUMENTS

| | | | |
|---|---|---|---|
| Re. 30,505 | 2/1981 | Jacob | 156/643 |
| 4,657,616 | 4/1987 | Benzing et al. | 156/643 X |
| 4,676,866 | 6/1987 | Tang et al. | 156/656 X |

*Primary Examiner*—William A. Powell
*Attorney, Agent, or Firm*—Harry Wolin

[57] ABSTRACT

A method for removing nitride coatings from metal tooling and mold surfaces without damaging the underlying base metal includes placing the nitride coated metal surface into a plasma reactor and subjecting it to a gaseous plasma comprising a reactive fluorine species. The reactive fluorine species may be derived from one or more of many well known gases. An optional step of cleaning the nitride coating is recommended.

15 Claims, No Drawings

NITRIDE REMOVAL METHOD

BACKGROUND OF THE INVENTION

This invention relates, in general, to a method for removing nitride coatings from metal surfaces, and more particularly to a method of removing nitride coatings from metal surfaces employing a gaseous plasma comprising a reactive fluorine species.

Metal tooling and mold surfaces are commonly coated for protection, to improve the wear characteristics and to better interact with the materials that the metal surface comes in contact with. Metal tooling and mold surfaces commonly employ chromium coatings for these reasons. However, once the chromium coating starts to wear through, it is extremely difficult to remove so that the metal tooling and mold surfaces may be recoated. One method of removing chromium coatings is reverse plating. However, this will often damage the underlying base metal, especially if the underlying base metal contains chromium itself. Another method used for removing chromium coatings is a wet chemical etch. Wet chemical etches often do not etch uniformly and therefore, the etch may also damage the underlying base metal. When the underlying base metal is damaged, the metal tooling or mold surface often will need to be reworked or will be rendered non-usable.

Another coating commonly used with metal tooling and molds is titanium nitride. In addition to improving wear characteristics and increasing metal tooling or mold lifetime, titanium nitride has excellent lubricity and is excellent n conjunction with plastics. However, titanium nitride is also difficult to remove from metal tooling and mold surfaces without damaging the underlying base metal. Various removal methods include wet chemical etching which encounters the same problems with titanium nitride as discussed above with chromium. Also employed is media blast removal. Again, this results in an uneven removal of the titanium nitride and possible damage to the underlying base metal.

Therefore, it would be highly desirable to have a method to remove coatings from metal tooling and mold surfaces that does not damage the underlying base metal.

SUMMARY OF THE INVENTION

Accordingly, it is an object of the present invention to provide a method for removing nitride coatings from metal tooling and mold surfaces.

Another object of the present invention is to provide a method for removing nitride coatings from metal tooling or mold surfaces that does not damage the underlying base metal.

It is an additional object of the present invention to provide a method for removing nitride coatings from metal tool and mold surfaces that employs dry etching techniques.

The foregoing and other objects and advantages are achieved in the present invention by one embodiment in which, as a part thereof, includes providing a metal tooling or mold surface having a nitride coating disposed thereon, placing the nitride coated metal surface into a plasma reactor and exposing the nitride coated metal surface to a gaseous plasma comprising a reactive fluorine species.

A more complete understanding of the present invention can be attained by considering the following detailed description.

DETAILED DESCRIPTION OF THE INVENTION

Typically, it is desirable to coat metal tooling and mold surfaces with nitride such as titanium nitride to protect the base metal, improve the wear characteristics and increase lubricity. Nitride coatings work extremely well on mold plates for use in encapsulating semiconductor devices as well as other types of tools and molds. However, nitride coatings have been extremely difficult to remove from the base metal surfaces without damaging the underlying metal once the nitride surfaces have begun to wear.

To remove nitride coatings from metal tooling and mold surfaces without damaging the underlying metal, it is desirable to clean the nitride coating. One way in which this may be done includes first cleaning the nitride coating with acetone followed by an isopropyl alcohol clean. The nitride coating is then subjected to a methanol clean which leaves no residue on the nitride coating. Finally, the nitride coated metal surface is placed into a plasma reactor and subjected to a gaseous plasma consisting of pure oxygen. It should be understood that impurities on the nitride coating will hinder the removal of the nitride coating itself.

Once the nitride coating has been cleaned, it is exposed to a gaseous plasma comprising a reactive fluorine species. The reactive fluorine species may be derived from one or more of the gases including $CF_4$, $CHF_3$, $C_2F_6$, $SF_6$ and other fluorine containing gases. The gaseous plasma may be derived from a single fluorine containing gas, a mixture of fluorine containing gases or a mixture of fluorine containing gases and non-fluorine containing gases. The method for removing nitride coatings from metal tooling and mold surfaces has been shown to work best in a plasma reactor having a barrel configured chamber wherein the chamber pressure is in the range of 0.5 to 5.0 torr, the chamber temperature is in the range of 40 to 100 degrees centigrade and the power applied to the plasma reactor is in the range of 100 to 1000 watts.

A specific example of a method for removing titanium nitride coatings from metal tooling and mold surfaces includes initially cleaning the titanium nitride coating in the manner disclosed above. Once the titanium nitride coating has been cleaned, the titanium nitride coated metal tooling or mold surface is placed into a plasma reactor having a barrel configured chamber such as a Tegal 965 plasma etcher. The chamber pressure is set to approximately 1.0 torr, the chamber temperature is approximately 80 degrees centigrade and the power applied to the plasma etcher is approximately 400 watts. The gas from which the plasma is derived is a mixture comprising 91.5% $CF_4$ and 8.5% $O_2$. It should be understood that the reaction time is dependent upon the amount of the titanium nitride coating disposed on the metal tooling or mold surface. The plasma containing the reactive fluorine species will not damage the underlying metal tooling or mold surface if it is removed within a reasonable amount of time following the complete removal of the titanium nitride coating.

Thus it is apparent that there has been provided, in accordance with the invention and improved method for removing nitride coatings from metal tooling and mold surfaces which meets the objects and advantages set forth above. While specific embodiments of the invention have been shown and described, further modifications and improvements will occur to the skilled in the art. It is desired that it be understood, therefore, that this invention is not limited to the particular forms shown and it is intended in the appended claims to cover all modifications which do not depart from the spirit and scope of this invention.

What is claimed is:

1. A method for removing nitride coatings from metal surfaces comprisng the steps of:

providing a metal surface having a nitride coating disposed thereon;

placing said nitride coated metal surface into a plasma reactor; and exposing said nitride coated metal surface to a gaseous plasma comprising a reactive fluorine species.

2. The method of claim 1 wherein the providing step includes providing a metal surface having a titanium nitride coating disposed thereon.

3. The method of claim 1 further comprising the step of cleaning the nitride coating disposed on the metal surfaces.

4. The method of claim 3 wherein the cleaning step comprises the steps of:

cleaning the nitride coating with acetone;

cleaning said nitride coating with isopropyl alcohol;

cleaning said nitride coating with methanol; and subjecting said nitride coating to a gaseous plasma consisting of oxygen.

5. The method of claim 1 wherein the exposing step includes exposing the nitride coated metal surface to a reactive fluorine species derived from one or more of the gases in the group comprising $CF_4$, $CHF_3$, $C_2F_6$ and $SF_6$.

6. The method of claim 1 wherein the placing step includes placing the nitride coated metal surface into a plasma reactor having a barrel configured chamber wherein the chamber pressure is in the range of 0.5 to 5.0 torr, the chamber temperature is in the range of 40 to 100 degrees centigrade and the power is in the range of 100 to 1000 watts.

7. The methods of claim 6 wherein the placing step includes placing the nitride coated metal surface into a plasma reactor having a barrel configured chamber wherein the chamber pressure is approximately 1.0 torr, the chamber temperature is approximately 80 degrees centigrade and the power is approximately 400 watts.

8. A method for removing nitride coating from metal tooling and mold surfaces comprising the steps of:

providing a metal tooling or mold surface having a nitride coating disposed thereon;

cleaning said nitride coating;

placing said nitride coated metal tooling or mold surface into a plasma reactor; and exposing said nitride coated metal tooling or mold surface to a gaseous plasma comprising a reactive fluorine species, said reactive fluorine species being derived from one or more of the gases in the group comprising $CF_4$, $CHF_3$, $C_2F_6$ and $SF_6$.

9. The method of claim 8 wherein the providing step includes providing a metal tooling or mold surface having a titanium nitride coating disposed thereon.

10. The method of claim 9 wherein the cleaning step comprises the steps of:

cleaning the titanium nitride coating with acetone;

cleaning said titanium nitride coating with isopropyl alcohol;

cleaning said titanium nitride coating with methanol; and subjecting said titanium nitride coating to a gaseous plasma consisting of oxygen.

11. The method of claim 10 wherein the placing step includes placing the titanium nitride coated metal tooling or mold surface into a plasma reactor having a barrel configured chamber wherein the chamber pressure is in the range of 0.5 to 5.0 torr, the chamber temperature is in the range of 40 to 100 degrees centigrade and the power is in the range of 100 to 1000 watts.

12. The method of claim 11 wherein the placing step includes placing the titanium nitride coated metal tooling or mold surface into a plasma reactor having a barrel configured chamber wherein the chamber pressure is approximately 1.0 torr, the chamber temperature is approximately 80 degrees centigrade and the power is approximately 400 watts.

13. A method for removing titanium nitride coatings from metal tooling or mold surfaces comprising the steps of:

providing a metal tooling or mold surface having a titanium nitride coating disposed thereon;

cleaning said titanium nitride coating;

placing said titanium nitride coated metal tooling or mold surface into a plasma reactor having a barrel configured chamber wherein the chamber pressure is in the range of 0.5 to 5.0 torr, the chamber temperature is in the range of 40 to 100 degrees centigrade and the power is in the range of 100 to 1000 watts; and exposing said nitride coated metal tooling or mold surface to a gaseous plasma comprising a reactive fluorine species being derived from one or more of the gases in the group comprising $CF_4$, $CHF_3$, $C_2F_6$ and $SF_6$.

14. The method of claim 13 wherein the cleaning step comprises the steps of:

cleaning the titanium nitride coating with acetone;

cleaning said titanium nitride coating with isopropyl alcohol;

cleaning said titanium nitride coating with methanol; and subjecting said titanium nitride coating to a gaseous plasma consisting of oxygen.

15. The method of claim 13 wherein the placing step includes placing a titanium nitride coated metal tooling or mold surface into a plasma reactor having a barrel configured chamber wherein the chamber pressure is approximately 1.0 torr, the chamber temperature is approximately 80 degrees centigrade and the power is approximately 400 watts.

* * * * *